US006822615B2

(12) United States Patent
Quan et al.

(10) Patent No.: US 6,822,615 B2
(45) Date of Patent: Nov. 23, 2004

(54) WIDEBAND 2-D ELECTRONICALLY SCANNED ARRAY WITH COMPACT CTS FEED AND MEMS PHASE SHIFTERS

(75) Inventors: Clifton Quan, Arcadia, CA (US); Jar J. Lee, Irvine, CA (US); Brian M. Pierce, Moreno Valley, CA (US); Robert C. Allison, Rancho Palos Verdes, CA (US)

(73) Assignee: Raytheon Company, Waltham, MA (US)

( * ) Notice: Subject to any disclaimer, the term of this patent is extended or adjusted under 35 U.S.C. 154(b) by 64 days.

(21) Appl. No.: 10/373,936

(22) Filed: Feb. 25, 2003

(65) Prior Publication Data

US 2004/0164915 A1 Aug. 26, 2004

(51) Int. Cl.[7] ..... H01Q 3/00
(52) U.S. Cl. ..... 343/754; 342/376
(58) Field of Search ..... 343/753, 754; 342/368, 369, 372, 376

(56) References Cited

U.S. PATENT DOCUMENTS 6,160,519 A * 12/2000 Hemmi ..... 343/754
6,421,021 B1 * 7/2002 Rupp et al. ..... 343/753
6,677,899 B1 * 1/2004 Lee et al. ..... 342/376

* cited by examiner

*Primary Examiner*—Michael C. Wimer
(74) *Attorney, Agent, or Firm*—Leonard A. Alkov; Karl A. Vick

(57) ABSTRACT

A microelectromechanical system (MEMS) steerable electronically scanned lens array (ESA) antenna and method of frequency scanning are disclosed. The MEMS ESA antenna includes a wide band feedthrough lens and a continuous transverse stub (CTS) feed array. The wide band feedthrough lens includes first and second arrays of wide band radiating elements and an array of MEMS phase shifter modules disposed between the first and second arrays of radiating elements. The continuous transverse stub (CTS) feed array is disposed adjacent the first array of radiating elements for providing a planar wave front in the near field. The MEMS phase shifter modules steer a beam radiated from the CTS feed array in two dimensions.

14 Claims, 5 Drawing Sheets

WIDEBAND 2-D ELECTRONICALLY SCANNED ARRAY WITH COMPACT CTS FEED AND MEMS PHASE SHIFTERS

TECHNICAL FIELD

The present invention relates generally to electronically scanned antennas and, more particularly, to an electronic scanned antenna with a microelectromechanical system (MEMS) radio frequency (RF) phase shifter.

BACKGROUND OF THE INVENTION

Advanced airborne and space based radar systems heretofore have used electronically scanned antennas (ESA) including thousands of radiating elements. For example, large fire control radars that engage multiple targets simultaneously may use ESAs to provide the required power aperture product.

Space based lens architecture is one approach to realizing ESA for airborne and space based radar systems. However, when the space based lens architecture is utilized at higher frequencies, for example, the X-band, and more active components such as phase shifters are packaged within a given area, weight, increased thermal density, and power consumption may deleteriously affect the cost and applicability of such systems.

Heretofore, phase shifter circuits for electronically scanned lens array antennas have included ferrites, PIN diodes and FET switch devices. These phase shifters are heavy, consume a considerable amount of DC power, and are expensive. Also, the implementation of PIN diodes and FET switches into RF phase shifter circuitry is complicated by the need of an additional DC biasing circuit along the RF path. The DC biasing circuit needed by PIN diodes and FET switches limits the phase shifter frequency performance and increases RF losses. Populating the ESA with presently available transmit/receive (TIR) modules is undesirable due to high costs, poor heat dissipation and inefficient power consumption. In sum, the weight, cost and performance of available phase shifter circuits fall short of what is needed for space based radar and communication ESA's, where thousands of these devices are used.

SUMMARY OF THE INVENTION

The present invention provides a microelectromechanical system (MEMS) steerable electronically scanned lens array (ESA) antenna. According to an aspect of the invention, the MEMS ESA antenna includes a wide band feedthrough lens and a continuous transverse stub (CTS) feed array. The wide band feedthrough lens includes first and second arrays of wide band radiating elements and an array of MEMS phase shifter modules disposed between the first and second arrays of radiating elements. The continuous transverse stub (CTS) feed array is disposed adjacent the first array of radiating elements for providing a planar wave front in the near field. The MEMS phase shifter modules steer a beam radiated from the CTS feed array in two dimensions.

According to another aspect of the invention, there is provided a method of frequency scanning radio frequency energy, comprising the steps of inputting radio frequency (RIF) energy into a continuous transverse stub (CTS) feed array, radiating the RF energy through a plurality of CTS radiating elements in the form of a plane wave in the near field, emitting the RF plane wave into an input aperture of a wide band feedthrough lens including a plurality of MEMS phase shifter modules, converting the RF wave plane into discreet RF signals, using the MEMS phase shifter modules to process the RF signals, radiating the RF signals through a radiating aperture of the wide band feedthrough lens, thereby recombining the RF signals and forming an antenna beam, and varying the frequency of the RF signal inputted into the CTS feed array thereby to change the angular position of the antenna beam in the E-plane of the wide band feedthrough lens and to effect frequency scanning by the antenna beam.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
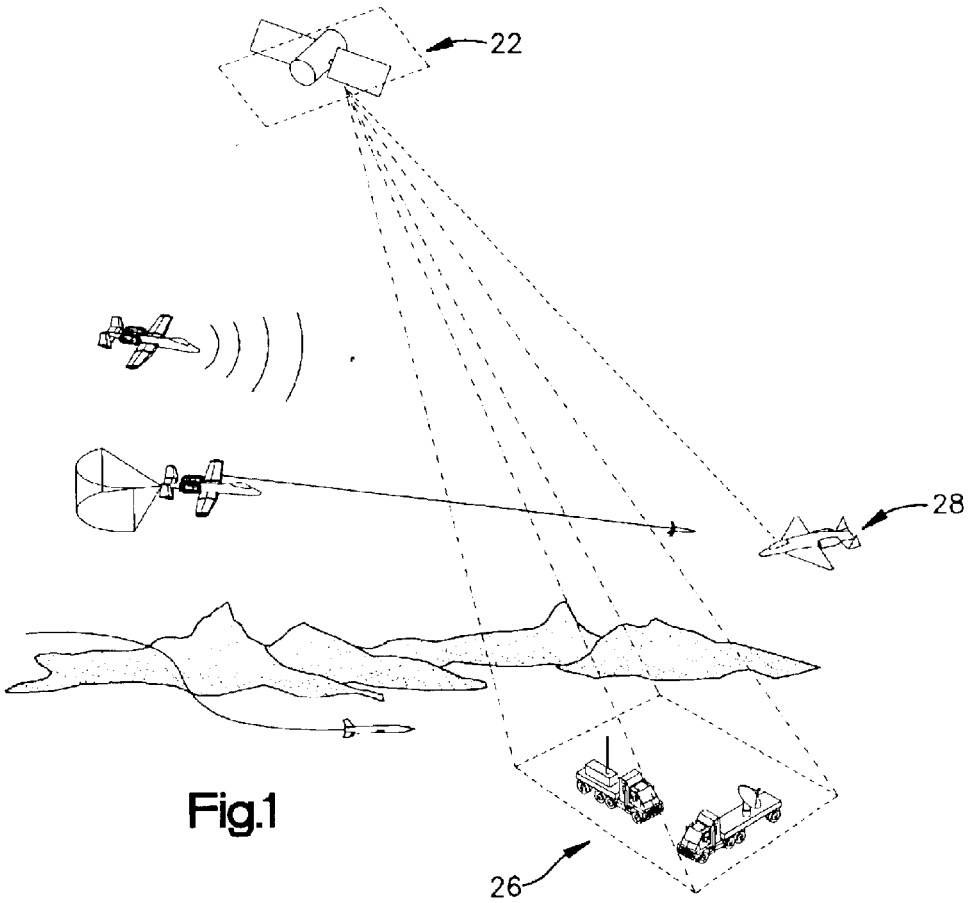
FIG. 1 is a schematic environmental view of several radar applications embodying an electronically scanned lens array (ESA) antenna with microelectromechanical system (MEMS) phase shifters in accordance with the present invention.

In the detailed description that follows, identical components have been given the same reference numerals, regardless of whether they are shown in different embodiments of the present invention. To illustrate the present invention in a clear and concise manner, the drawings may not necessarily be to scale and certain features may be shown in somewhat schematic form.

Figure 2:
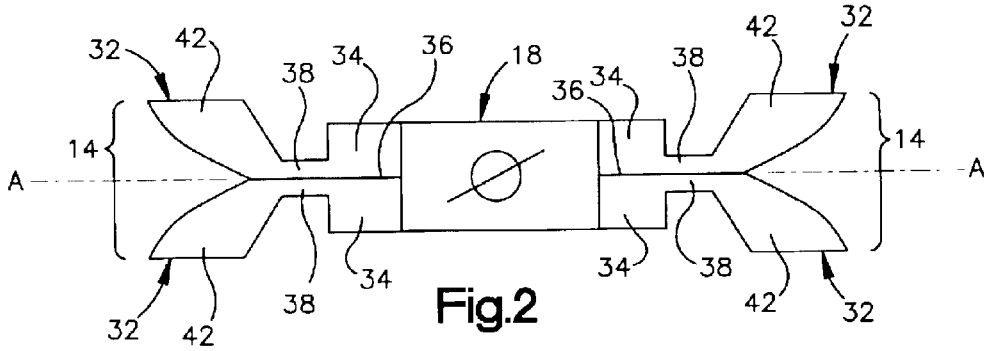
FIG. 2 illustrates a top plan view of a pair of wide band radiating elements and a MEMS phase shifter module in accordance with the present invention.
Figure 3:
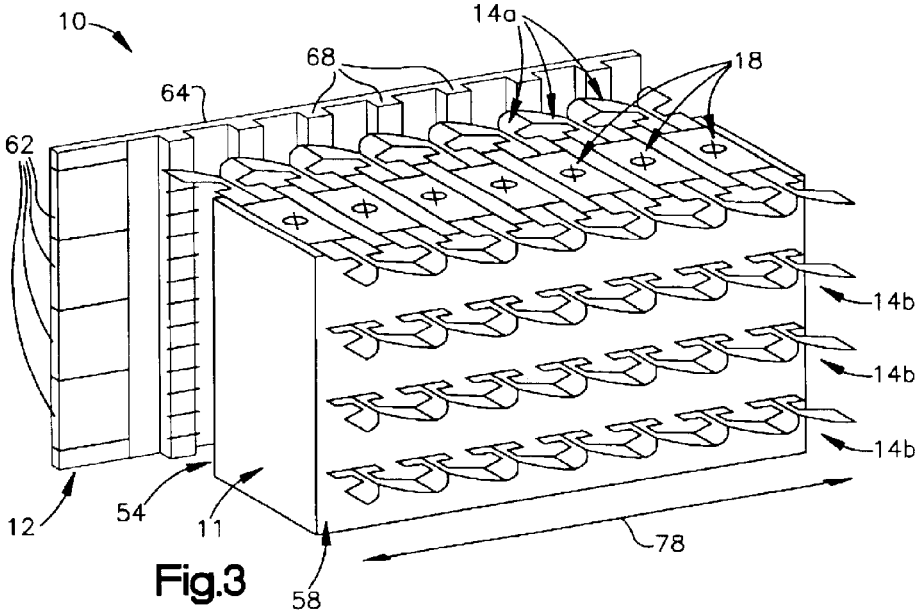
FIG. 3 illustrates an electronically scanned lens array antenna in accordance with the present invention, the lens antenna including a wide band feedthrough lens with seven MEMS phase shifter modules and a continuous transverse stub (CTS) feed array having seven CTS radiating elements.

Referring initially to FIGS. 1–3, the present invention is a two dimensional microelectromechanical system (MEMS) steerable electronically scanned lens array antenna 10 (FIG. 3) including a wide band feedthrough lens 11 and a continuous transverse stub (CTS) feed array 12. The wide band feedthrough lens 11 includes a rear array of wide band radiating elements 14*a*, a front array of wide band radiating elements 14*b*, and an array of MEMS phase shifter modules 18 (FIG. 2) sandwiched between the rear and front arrays of radiating elements 14*a* and 14*b*. The CTS feed array 12, which is positioned adjacent the rear array of radiating elements 14*a*, provides a planar wave front in the near field. The MEMS phase shifter modules 18 steer a beam radiated from the CTS feed array 12 in two dimensions, that is in the E-plane and H-plane, and, accordingly, the CTS feed array 12 need only generate a fixed beam. As will be appreciated, the present invention obviates the need for transmission lines, power dividers, and interconnects that are customarily associated with corporate fed antennas.

The antenna 10 is suitable in both commercial and military applications, including for example, aerostats, ships, surveillance aircraft, and spacecraft. FIG. 1 shows an environmental view of several advanced airborne and space based radar systems in which the antenna 10 may be suitably incorporated. These systems include, for example, lightweight X-band space-based radar for synthetic aperture radar (SAR) systems 22, ground moving target indication (GMTI) systems 26, and airborne moving target indication (AMTI) systems 28. These systems use a substantial number of antennas, and the antenna 10 of the present invention by means of the MEMS phase shifter modules 18 has been found to have a relatively lower cost, use relatively less power, and be lighter in weight than prior art antennas using PIN diode and FET switch phase shifters or transmit/receive (T/R) modules.

As is shown in FIG. 2, each MEMS phase shifter module 18 is sandwiched between a pair of opposite facing wide band radiating elements 14. In the illustrated embodiment, the radiating elements 14 have substantially the same geometry and are disposed symmetrically about the MEMS phase shifter module 18 and about an axis A representing the feed/radiating direction through the antenna 10 and more particularly through the MEMS phase shifter module 18 thereof. As will be appreciated, alternatively the radiating elements 14 may have a different geometry and/or be disposed asymmetrically about the MEMS phase shifter module 18 and/or the feed/radiating axis A. In other words, the front or output radiating element 14*b* may have a different geometry than the rear or input radiating element 14*a*.

Each wide band radiating element 14 includes a pair of claw-like projections 32 having a rectangular base portion 34, a relatively narrower stem portion 38, and an arcuate distal portion 42. The claw-like projections 32 form slots 36 therebetween that provide a path along which RF energy propagates (for example, in the direction of the feed/radiating axis A) during operation of the antenna 10. The base portions 34, also referred to herein as ground planes, are adjacent one another about the feed/radiating axis A and adjacent the phase shifter module 18 at opposite ends of the phase shifter module 18 in the direction of the feed/radiating axis A. Together the base portions 34 have a 15 width substantially the same as the width of the MEMS phase shifter module 18. The stem portions 38 are narrower than the respective base portions 34 and project from the base portions 34 in the direction of the feed/radiating axis A and are also adjacent one another about the feed/radiating axis A. The arcuate distal portions 42 project from the respective stem portions 38 in the direction of the feed/radiating axis A and branch laterally away from the feed/radiating axis A and away from one another. The arcuate distal portions 42 together form a flared or arcuate V-shaped opening that flares outward from the phase shifter module 18 in the direction of the feed/radiating axis A. The flared opening of a wide band radiating element 14 at the rear end of the wide band feedthrough lens 11 receives and channels radio frequency (RF) energy from the CTS feed array 12, and propagates the RF energy along the corresponding slot 36 to the corresponding MEMS phase shifter module 18. The flared opening of a wide band radiating element 14 at the opposite or front end of the wide band feedthrough lens 11 radiates RF energy from the corresponding MEMS phase shifter module 18 along the corresponding slot 36 and into free space.

Figure 4:
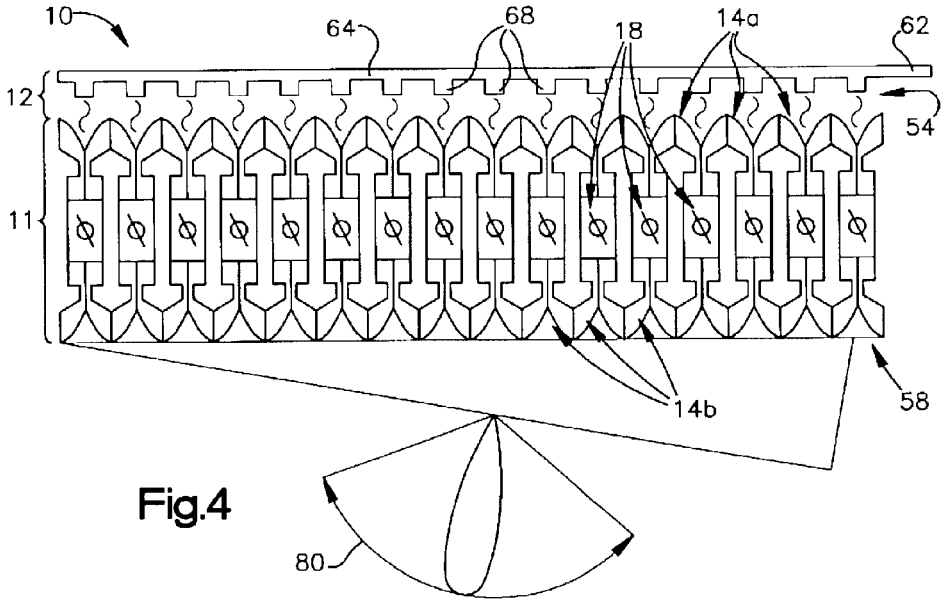
FIG. 4 is a top plan view of the FIG. 3 electronically scanned lens array antenna, except that the FIG. 4 lens antenna has 16 MEMS phase shifter modules and CTS radiating elements.

Turning to FIG. 3, the MEMS phase shifters 18 are configured as an array in the wide band feedthrough lens 11. Thus, the wide band feedthrough lens 11 includes an input aperture 54 comprising an array of input radiating elements 14*a* behind the MEMS phase shifters 18, and an output or radiating aperture 58 comprising an array of output radiating elements 14*b* in front of the MEMS phase shifters 18. The feedthrough lens 11 of FIG. 3 has an array of four (4) rows and seven (7) columns of MEMS phase shifters 18 and four (4) rows and seven (7) columns of input and output radiating elements 14*a* and 14*b*. It will be appreciated that the array may comprise any suitable quantity of MEMS phase shifters 18 and input and output radiating elements 14*a* and 14*b* as may be desirable for a particular application. For example, in FIG. 4, the wide band feedthrough lens 11 includes 16 MEMS phase shifters 18 and 16 input and output wide band radiating elements 14*a* and 14*b*.

The wide band feedthrough lens 11 is space fed by the CTS feed array 12. The CTS feed array 12, illustrated in FIGS. 3 and 4, includes a plurality of RF inputs 62 (four in the FIG. 3 embodiment), a continuous stub 64 and a plurality of CTS radiating elements 68 projecting from the continuous stub 64 toward the input aperture 54 of the wide band feedthrough lens 11. In the illustrated embodiment, the CTS radiating elements 68 correspond in quantity to the input and output radiating elements 14*a* and 14*b*. Also, in the illustrated embodiment, the CTS radiating elements 68 are transversely spaced apart substantially the same distance as the transverse spacing between the input radiating elements 14*a* and the transverse spacing between the output radiating elements 14*b*. It will be appreciated that the spacing between the CTS radiating elements 68 need not be the same as or correspond to the spacing between the input radiating elements 14*a*. Moreover, it will be appreciated that the CTS radiating elements 68 (that is, the columns) and/or the RF inputs 62 (that is, the rows) of the CTS feed array 12 need not be the same and/or align with or correspond to the columns and rows of input and output radiating elements 14*a* and 14*b* and/or the MEMS phase shifter modules 18 of the wide band feedthrough lens 11. Thus, the CTS feed array 12 may have more or fewer rows and or/columns than the wide band feedthrough lens 11 depending on, for example, the particular antenna application.

Figure 5:
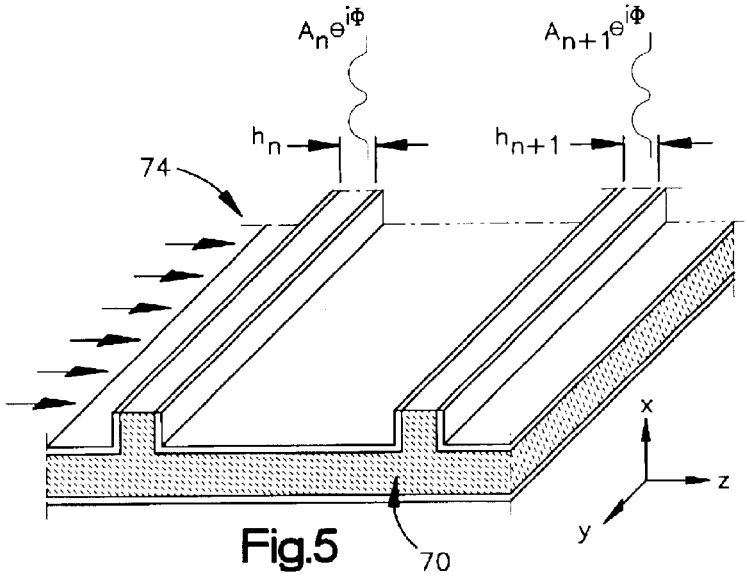
FIG. 5 is a cross-sectional view of a segment of the continuous transverse stub (CTS) array of FIG. 3.
Figure 6:
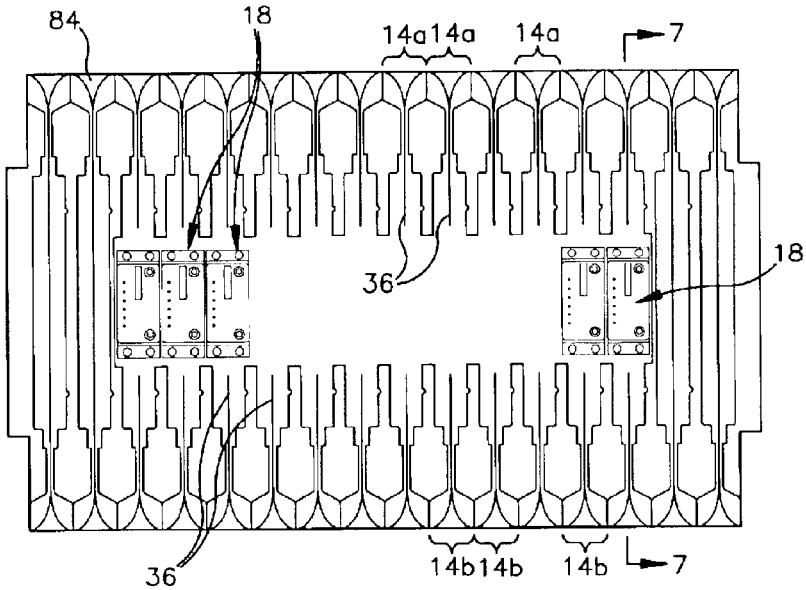
FIG. 6 illustrates a printed circuit board (PCB) including an array of printed wide band radiating elements, and an array of MEMS phase shifter modules on the PCB in accordance with the present invention.

FIG. 5 is a cross-sectional view of a segment of the CTS feed array 12 of FIG. 3. The CTS feed array 12 includes a dielectric 70 that is made of plastic such as rexolite or polypropylene, and is machined or extruded to the shape shown in FIG. 5. The dielectric 70 is then metallized with a metal layer 74 to form the continuous stub 64 and CTS radiating elements 68. The CTS feed array 12 lends itself to high volume plastic extrusion and metal plating processes that are common in automotive manufacturing operations and, accordingly, facilitates low production costs.

The CTS feed array 12 is a microwave coupling/radiating array. As is shown in FIG. 5, incident parallel waveguide modes launched via a primary line feed of arbitrary configuration have associated with them longitudinal electric current components interrupted by the presence of the continuous stub 64, thereby exciting a longitudinal, z-directed displacement current across the stub/parallel plate interface. This induced displacement current in turn excites equivalent electromagnetic waves traveling in the continuous stub 64 in the x direction to the CTS radiating elements 68 into free space. It has been found that such CTS non-scanning antennas may operate at frequencies as high as 94 GHz. For further details relating to an exemplary CTS feed array reference may be had to U.S. Pat. Nos. 6,421,021; 5,361,076; 5,349,363; and 5,266,961, all of which are hereby incorporated herein by reference in their entireties.

In operation, RF energy is series fed from the RF input 62 into the CTS radiating elements 68 via the parallel plate waveguide of the CTS feed array 12 and is radiated out in the form of a plane wave in the near field. It is noted that the distances that the RF energy travels from the RF input 62 to the CTS radiating elements 68 are not equal. The RF plane wave is emitted into the input aperture 54 of the wide band feedthrough lens 11 by the CTS radiating elements 68 and then converted into discreet RF signals. The RF signals are then processed by the MEMS phase shifter modules 18. For further details relating to an MEMS phase shifter reference may be had to U.S. Pat. Nos. 6,281,838; 5,757,379; and 5,379,007, all of which are hereby incorporated herein by reference in their entireties.

The MEMS processed signals are then re-radiated out through the radiating aperture 58 of the wide band feedthrough lens 11, which then recombines the RF signals and forms the steering antenna beam. For such a series fed CTS feed array 12, the antenna beam moves at different angular positions along the E-plane 78 (FIG. 3) as a function of frequency, as is illustrated for example at reference numeral 80 in FIG. 4. As the frequency varies, the output phase of each CTS radiating element 68 changes at different rates resulting in frequency scanning.

In an alternative embodiment, a wide band frequency is achieved by feeding the CTS radiating elements 68 in parallel using a corporate parallel plate waveguide feed (not shown). By parallel feeding the CTS radiating elements 68, the distances that the RF energy travels from the RF input 62 to the CTS radiating elements 68 are equal. As the frequency varies, the output phase of each CTS radiating element 68 changes at substantially the same rate, and thus the antenna beam radiated out through the radiating aperture 58 remains in a fixed position.

FIGS. 6–10 show an exemplary embodiment of an array of wide band radiating elements 14*a* and 14*b* and MEMS phase shifter modules 18 in which the wide band radiating elements 14*a* and 14*b* are fabricated onto a printed circuit board (PCB) 84, and the MEMS phase shifter modules 18 are mounted to the PCB 84 between the input and output radiating elements 14*a* and 14*b*. Each MEMS phase shifter module 18 includes a housing 86 (FIG. 9) made of kovar, for example, and a suitable number of MEMS phase shifter switches (not shown), for example two, mounted to the housing 86. It will be appreciated that the number of MEMS phase shifter switches will depend on the particular application.

Figure 7:
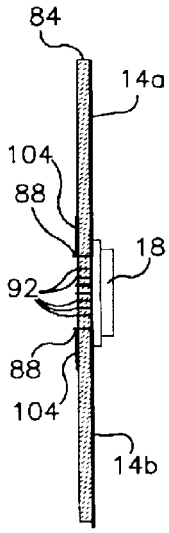
FIG. 7 is a side elevational view of the FIG. 6 PCB and MEMS phase shifter modules as viewed from the line 7—7 in FIG. 6.
Figure 8:
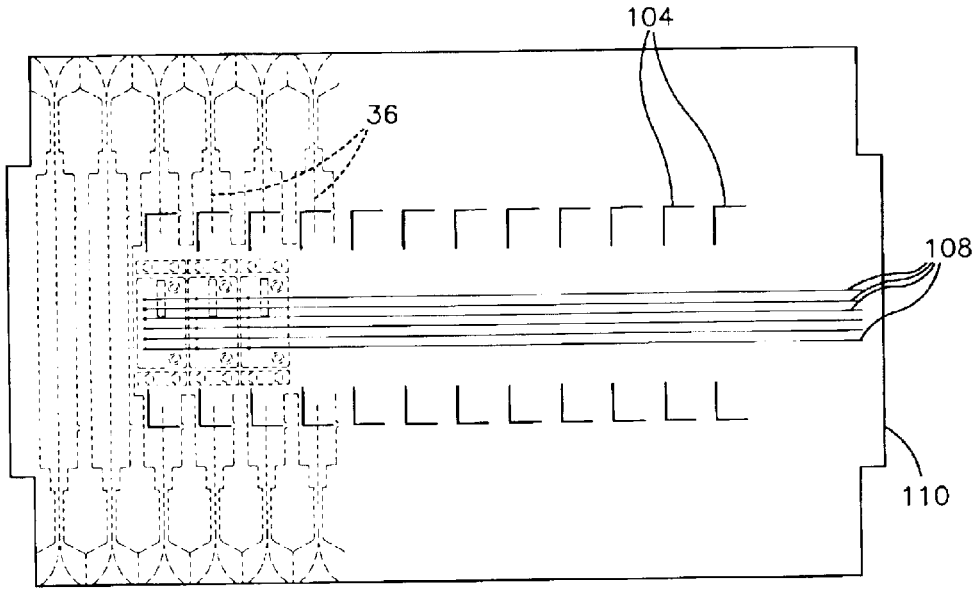
FIG. 8 is a bottom view of the FIG. 6 PCB and MEMS phase shifter modules.
Figure 9:
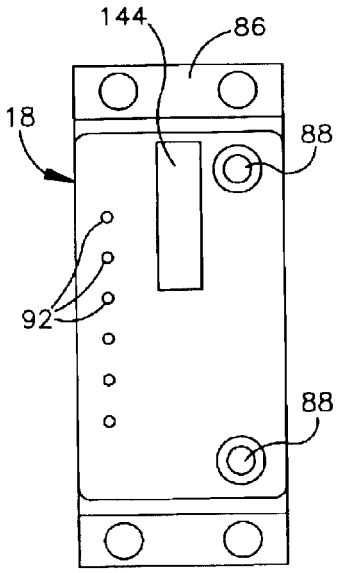
FIG. 9 is an enlarged view of a MEMS phase shifter module in accordance with the present invention.

A pair of RF pins 88 and a plurality of DC pins 92 protrude from the bottom of the housing 86 in a direction substantially normal to the plane of the housing 86 (FIG. 7). The RF pins 88 correspond to the respective input and output radiating elements 14*a* and 14*b*. The RF pins 88 extend through the thickness of the PCB 84 in a direction normal to the plane of the PCB 84, and are electrically connected to respective microstrip transmission lines 104 (that is, a balun) that are mounted on the side of the PCB 84 opposite to that which the RF MEMS phase shifter modules 18 are mounted (FIGS. 7 and 8). The transmission lines 104 are electrically coupled to the respective input and output radiating elements 14*a* and 14*b* to carry RF signals to and from the input and output radiating elements 14*a* and 14*b*. In the illustrated exemplary embodiment, the transmission lines 104 are L-shaped, and have one leg extending across the respective slots 36 in the rectangular base portion 34 (FIG. 2) of the respective radiating elements 14*a* and 14*b*. The rectangular base portion 34 functions as a ground plane for the transmission line 104. At the slot 36, there is a break across the ground plane (that is, the rectangular portion 34) which causes a voltage potential, thereby to force RF energy to propagate along the slot 36 of the respective radiating elements 14*a* and 14*b*.

The DC pins 92 also extend through the thickness of the PCB 84 and arc electrically connected to DC control signal and bias lines 108. The DC control signal and bias lines 108 are routed along the center of the PCB 84 and extend to an edge 110 of the PCB 84.

It will be appreciated that the orientation of the RF pins 88 and the DC pins 92 relative to the plane of the housing 86 of the MEMS phase shifter modules 18 enables the RF pins 88 and DC pins 92 to be installed vertically. Such vertical interconnect feature makes installation of the MEMS phase shifter modules 18 relatively simple compared to, for example, conventional MMICS with coaxial connectors or external wire bonds, or other conventional packages having end-to-end type connections requiring numerous process operations. The vertical interconnects provide flexibility in installation, enabling, for example, a surface mount, pin grid array, or BGA type of package.

Figure 10:
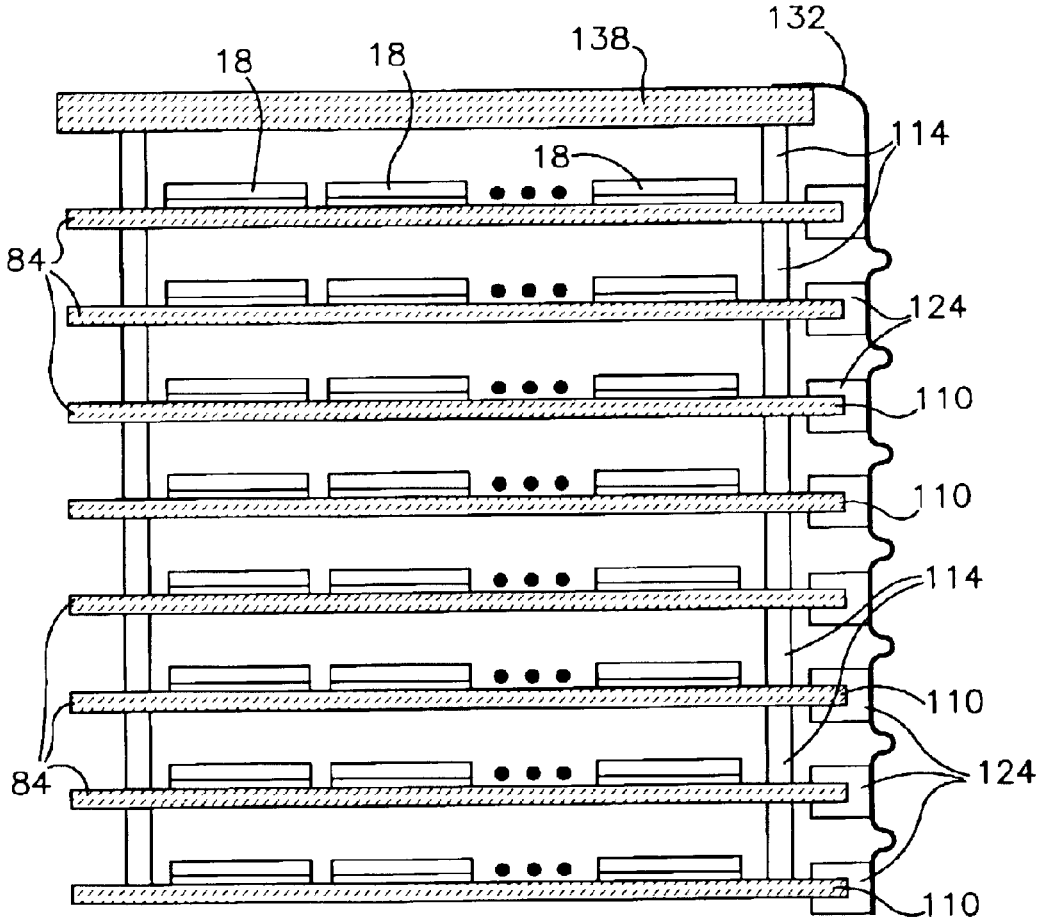
FIG. 10 illustrates a MEMS steerable electronically scanned lens array antenna in accordance with the present invention, showing the mounting structure and connecting lines thereof in greater detail.

As is shown in FIG. 10, multiple PCBs 84 (eight in the illustrated exemplary embodiment) each representing a row of the wide band feedthrough lens 11 may be stacked or vertically arranged in column-like fashion, and spaced apart by spacers 114. In this way, the input and output radiating elements 14*a* and 14*b* of the respective input and radiating apertures 54 and 58 of the wide band feedthrough lens 11 are configured in two dimensions, that is a lattice structure of rows and columns of input and output radiating elements 14*a* and 14*b* is formed. The lattice spacing may be selected based on, for example, the frequency and scanning capabilities desired for a particular application.

The DC control signal and bias lines 108 of each PCB 84 engage a connector 124. In the illustrated embodiment, there are eight connectors 124. The connectors 124 in turn are electrically coupled together via a connecting cable 132, which in turn is connected to a DC distribution printed wiring board (PWB) 138.

Referring again to FIG. 9, an application specific integrated circuit (ASIC) control driver circuit 144, which provides the E-plane and H-plane two dimensional scanning, is mounted in or to the housing 86 of each phase shifter module 18. The ASIC circuit 144 enables the DC inputs/outputs of adjacent MEMS phase shifter modules 18 to be connected together serially. The ASIC circuit 144 controls the individual MEMS phase shifter phase settings of the MEMS phase shifter module 18 in which it is installed, and allows serial command and biasing of the MEMS phase shifter switches. As will be appreciated, the design of the ASIC circuit 144 may be according to current CMOS IC manufacturing processes, for example.

Together, the MEMS phase shifter modules 80 and the wide band radiating elements 14*a* and 14*b* that make up the input aperture 54 and radiating aperture 58 of the wide band feedthrough lens 11, as oriented in the illustrated exemplary embodiment, effect E-plane 78 scanning that occurs parallel to the rows of radiating elements 14*a* and 14*b*, and H-plane scanning that occurs perpendicular to the rows of radiating elements 14*a* and 14*b*. To adjust the phase shifter settings for each MEMS phase shifter module 18, a serial command from a beam steering computer is sent via the DC distribution PWB 138 to each MEMS phase shifter module 18 along the row, where it is received by a differential line receiver built within the ASIC circuit 144. The logic control circuitry built within each ASIC circuit 144 may be used adjust the bias of each MEMS phase shifter switch to realize a desired phase shift output. Each ASIC circuit 144 thus effects E-plane and H-plane steering, or two dimensional scanning, of the beam radiated from the antenna 10.

Although the invention has been shown and described with respect to certain illustrated embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

The present invention includes all such equivalents and modifications, and is scope of the following claims.

What is claimed is:

1. A microelectromechanical system (MEMS) steerable electronically scanned lens array (ESA) antenna, comprising:

a wide band feedthrough lens including first and second arrays of wide band radiating elements, and an array of MEMS phase shifter modules disposed between the first and second arrays of radiating elements; and, a continuous transverse stub (CTS) feed array disposed adjacent the first array of radiating elements for providing a planar wave front in the near field;

wherein the MEMS phase shifter modules steer a beam radiated from the CTS feed array in two dimensions.

2. The MEMS ESA antenna of claim 1, wherein the first and second arrays of wide band radiating elements are fabricated onto a printed circuit board (PCB), and the MEMS phase shifter modules are mounted to the PCB between the input and output wide band radiating elements.

3. The MEMS ESA antenna of claim 2, wherein each MEMS phase shifter module includes a pair of RF pins corresponding to respective first and second radiating elements of the first and second arrays of radiating elements of the wide band feed through lens.

4. The MEMS ESA antenna of claim 3, wherein the RF pins extend through the thickness of the PCB and electrically connect to respective microstrip transmission lines that are mounted on the side of the PCB opposite to that which the RF MEMS phase shifter modules are mounted, the microstrip transmission lines being operative to carry the RF signals to and from the respective first and second radiating elements.

5. The MEMS ESA antenna of claim 2, wherein each MEMS phase shifter module includes a plurality of DC pins that extend through the thickness of the PCB and electrically connect to respective DC control signal and bias lines that are mounted on the side of the PCB opposite to that which the RF MEMS phase shifter module are mounted, and are routed along the center of the PCB and extend to an edge of the PCB, where the DC control signal and bias lines DC are connected to a DC distribution line.

6. The MEMS ESA antenna of claim 2, wherein each MEMS phase shifter module includes a pair of RF pins corresponding to respective first and second radiating elements of the first and second arrays of radiating elements of the wide band feedthrough lens, and a plurality of DC pins for receiving serial commands from a beam steering computer to at least partially steer the beam radiated from the CTS feed array, and wherein the RF pins and DC pins arc oriented perpendicularly with respect to a housing of the respective MEMS phase shifter module to enable interconnection of same to the PCB in a relatively vertical manner.

7. The MEMS ESA antenna of claim 2, wherein two or more PCBs are vertically arranged in column-like fashion and spaced apart by spacers to form a lattice structure of rows and columns of radiating elements.

8. The MEMS ESA antenna of claim 7, wherein the lattice spacing is based on the frequency and scanning capabilities of an antenna application.

9. The MEMS ESA antenna of claim 1, further including an application specific integrated circuit (ASIC) control/driver circuit mounted with respect to each phase shifter module to connect electrically serially together adjacent MEMS phase shifter modules and to control individual phase settings of the respective MEMS phase shifter module.

10. The MEMS ESA antenna of claim 1, wherein the wide band radiating elements of the wide band feedthrough lens are oriented such that E-plane scanning occurs parallel to the rows of radiating elements.

11. A method of frequency scanning radio frequency energy, comprising the steps of.

inputting radio frequency (RF) energy into a continuous transverse stub (CTS) feed array;

radiating the RF energy through a plurality of CTS radiating elements in the form of a plane wave in the near field;

emitting the RF plane wave into an input aperture of a wide band feedthrough lens including a plurality of MEMS phase shifter modules;

converting the RF plane wave into discreet RF signals;

using the MEMS phase shifter modules to process the RF signals;

radiating the RF signals through a radiating aperture of the wide band feedthrough lens, thereby recombining the RF signals and forming an antenna beam; and, varying the frequency of the RF signal inputted into the CTS feed array thereby to change the angular position of the antenna beam in two dimensions and to effect frequency scanning by the antenna beam.

12. The method of claim 11, wherein the step of inputting RF energy includes feeding the CTS radiating elements in series.

13. The method of claim 12, further including the step of adjusting the phase shifter output for the respective MEMS phase shifter modules by adjusting the bias of one or more MEMS phase shifter switches in the respective MEMS phase shifter module.

14. The method of claim 13, wherein the step of adjusting the bias of one or more MEMS phase shifter switches includes sending a serial command from a beam steering computer to the respective MEMS phase shifter module and using an ASIC circuit to process the command and thereby adjust the bias of the one or more MEMS phase shifter switches.

* * * * *